US006648998B2

(12) United States Patent
Doll et al.

(10) Patent No.: US 6,648,998 B2
(45) Date of Patent: Nov. 18, 2003

(54) REDUCED SENSITIVITY MELT-CAST EXPLOSIVES

(75) Inventors: Daniel W. Doll, Ogden, UT (US); Jami M. Hanks, Logan, UT (US); Thomas K. Highsmith, North Ogden, UT (US); Gary K. Lund, Malad, IN (US); John B. Niles, Lake Hopatacong, NJ (US)

(73) Assignee: Alliant Techsystems Inc., Edina, MN (US)

( * ) Notice: Subject to any disclaimer, the term of this patent is extended or adjusted under 35 U.S.C. 154(b) by 116 days.

(21) Appl. No.: 09/747,303

(22) Filed: Dec. 21, 2000

(65) Prior Publication Data

US 2002/0038682 A1 Apr. 4, 2002

Related U.S. Application Data

(60) Provisional application No. 60/171,490, filed on Dec. 22, 1999.

(51) Int. Cl.[7] ..... C06B 45/06
(52) U.S. Cl. ..... 149/18
(58) Field of Search ..... 149/39, 18

(56) References Cited

U.S. PATENT DOCUMENTS

| | | | | |
|---|---|---|---|---|
| 2,988,435 | A | * | 6/1961 | Stanley et al. ..... 52/5 |
| 3,146,140 | A | * | 8/1964 | Milani ..... 149/107 |
| 3,379,585 | A | | 4/1968 | Miller et al. |
| 3,574,298 | A | | 4/1971 | Larson |
| 3,620,857 | A | | 11/1971 | Soderberg et al. |
| 3,957,550 | A | | 5/1976 | Tannenbaum et al. |
| 3,994,756 | A | | 11/1976 | Hendrickson, Sr. et al. |
| 4,201,853 | A | | 5/1980 | Henry et al. |
| 4,360,394 | A | | 11/1982 | Portnoy |
| 4,600,452 | A | | 7/1986 | Jessop et al. |
| 4,705,582 | A | | 11/1987 | Aubert |
| 4,747,892 | A | | 5/1988 | Spencer |
| 4,889,571 | A | | 12/1989 | Willer et al. |
| 5,067,996 | A | | 11/1991 | Lundstrom et al. |
| 5,302,763 | A | | 4/1994 | Quakenbush |
| 5,358,587 | A | | 10/1994 | Voigt, Jr. |
| 5,398,612 | A | | 3/1995 | Graham et al. |
| 5,431,756 | A | | 7/1995 | Kosowski et al. |
| 5,468,313 | A | | 11/1995 | Wallace, II et al. |
| 5,500,060 | A | | 3/1996 | Holt et al. |
| 5,529,649 | A | | 6/1996 | Lund et al. |
| 5,552,000 | A | | 9/1996 | Shepherd, Jr. |
| 5,587,553 | A | | 12/1996 | Braithwaite et al. |
| 5,717,158 | A | | 2/1998 | Capellos et al. |
| 5,949,016 | A | | 9/1999 | Baroody et al. |
| 5,997,668 | A | | 12/1999 | Aubert et al. |
| 6,425,966 | B1 | | 7/2002 | Highsmith et al. |

FOREIGN PATENT DOCUMENTS

| | | | |
|---|---|---|---|
| DE | 100 522 | C | 6/1897 |
| DE | 12 21 945 | B | 7/1966 |
| DE | 23 35 925 | A | 2/1975 |
| DE | 37 44 680 | A | 11/1991 |
| FR | 349 635 | A | 4/1904 |
| WO | 493638 | A1 * | 7/1992 |

* cited by examiner

*Primary Examiner*—John Hardee
(74) *Attorney, Agent, or Firm*—TraskBritt

(57) ABSTRACT

This melt-cast explosive shares comparable explosive properties to those of COMP B explosives and is melt-pourable and castable under conditions comparable to those of COMP B explosives, but experiences less impact, shock, and thermal sensitivity and avoids the issues of toxicity associated with COMP B. A fundamental and well-accepted component of COMP B, i.e., trinitrotoluene (TNT), is replaced with one or more mononitro-substituted or dinitro-substituted melt-cast binders, such as dinitroanisole, which can be melt cast without presenting the toxicity drawbacks experienced with the use of TNT. The melt-cast binder can also be combined with a processing aid selected from the group consisting of alkylnitroanilines and arylnitroanilines. Preferably, the composition also includes coarse oxidizer particles and energetic filler in fine particulate form.

21 Claims, No Drawings

REDUCED SENSITIVITY MELT-CAST EXPLOSIVES

RELATED APPLICATION

Priority is claimed of U.S. Provisional Application 60/171,490 filed in the U.S. Patent & Trademark Office on Dec. 22, 1999.

GOVERNMENT LICENSING CLAUSE

The U.S. Government has a paid-up license in this invention and the right in limited circumstances to require the patent owner to license others on reasonable terms as provided by the terms of DAAE30-97-C-1040 to Picatinny Arsenal.

BACKGROUND OF THE INVENTION

1. Field of the Invention

This invention relates to melt-cast explosives, and in particular to melt-cast explosives suitable for use in mortars, grenades, artillery shells, warheads, and antipersonnel mines.

2. Description of the Related Art

Melt-cast explosives based on a 2,4,6-trinitrotoluene (TNT) melt-cast binder have been used in a wide array of military applications. Among the TNT-based compositions known for making melt-cast explosives, COMP B (also commonly referred to in the art as Composition B) is one of the more widely known and practiced. Generally, COMP B comprises a mixture of TNT, RDX (1,3,5-trinitro-1,3,5-triaza-cyclohexane), and beeswax. Although the precise concentrations of these ingredients may vary somewhat in industry practice, generally COMP B includes about 39.5 wt % TNT, about 59.5 wt % RDX class 1 (100 $\mu$m) and about 1 wt % wax.

COMP B is typically prepared by initially melting the TNT melt-cast binder, which has a relatively low melting temperature of about 81° C. RDX particles and wax (optionally pre-coated on the RDX particles) are then stirred into the melted TNT until a slurry or homogeneous dispersion is obtained. The molten slurry can be poured into shells or casings for mortars, grenades, artillery, warheads, mines, and the like by a casting process, then allowed to cool and solidify. The melt pourability of COMP B is characteristic of melt-cast explosives.

As widely acknowledged in the art, however, melt-cast explosives compositions such as COMP B have several drawbacks. One of the most acknowledged of these drawbacks is the tendency of melt-cast explosives to shrink and crack upon cooling. Separation of the melt-cast explosive from its shell or casing and the formation of cracks within the explosive significantly increases the shock (or impact) sensitivity of the melt-cast explosive. Due to this increase in shock/impact sensitivity, melt-cast explosives made of COMP B and the like have been determined to lack sufficient predictability for some military applications. In particular, such melt-cast explosives are particularly prone to premature detonation when used adjacent to an ordnance motor. Moreover, due to the high thermal sensitivity and toxicity of TNT as a melt-cast binder, safety precautions are often required in practicing melt-cast techniques, thereby adding to manufacturing costs, slowing production rates, and raising worker safety issues. TNT is no longer produced domestically. The primary reason is because the manufacture of TNT produces toxic by-products known as pink water. During the TNT purification process, the meta isomers produced during the nitration of toluene react with the sodium sulfite to produce water soluble, sulfated nitro toluene that is red and highly toxic. The waste stream clean up is labor intensive, thereby increasing cost significantly.

SUMMARY OF THE INVENTION

It is, therefore, an object of this invention to address a significant need in the art by providing a melt-cast explosive that shares comparable explosive properties to those of COMP B explosives and is melt-pourable and castable under conditions comparable to those of COMP B explosives, but experiences less impact, shock, and thermal sensitivity and avoids the issues of toxicity associated with COMP B.

In accordance with the principles of this invention, the above and other objects are attained by replacing a fundamental and well-accepted component of COMP B, i.e., the trinitrotoluene (TNT) melt-cast binder, with one or more mononitro-substituted arenes or dinitro-substituted arenes, such as dinitroanisole. It has been discovered that mononitro-substituted and dinitro-substituted arenes such as dinitroanisole can be melt cast without presenting the toxicity drawbacks experienced with the use of TNT. Additionally, many mononitro-substituted and dinitro-substituted arenes are lower in costs and more widely available than TNT. Mononitro- and dinitro-arenes are less detonable than tri-nitrated arenes. Therefore, the mononitro- and dinitro-arenes do not require the explosive transportation, storage, and packaging infrastructure that tri-nitrated compounds, such as TNT, mandate.

Generally, the use of mononitro-substituted and dinitro-substituted arenes in place of TNT for melt-cast compositions has been disfavored (if not overlooked) in the melt-casting art due to the lower energetic oxygen content of the mononitro-substituted and dinitro-substituted arenes compared to TNT. This drawback has been recognized and overcome by the inventors by the addition of coarse oxidizer particles to the melt-cast composition. As referred to herein, coarse means particles having a granular appearance. The coarse oxidizer particles compensate for the energy loss experienced by the replacement of TNT with the less-energetic mononitro-substituted and/or dinitro-substituted arene melt-cast binder. Further, relatively large coarse oxidizer particles reduce the shock, impact, and thermal sensitivities. Inorganic oxidizers are preferred.

Additionally, the different melting points of mononitro-substituted and dinitro-substituted arenes from that of TNT have also disfavored the melt-cast binder substitution proposed by the inventors. Melt casting requires heating of the melt-cast binder to a temperature higher than its melting point, so that the binder can be mixed with the energetic filler and cast by melt pouring. A typical and useful melting point range for the melt or pour process is 80° C. to 110° C. However, melt-cast compositions should not be heated close to or above their autoignition temperatures, since the compositions will ignite automatically and generate an exothermic burn or explosion if heated to their autoignition temperatures. Preferably, a relatively wide "safety margin" is present between the melt temperature of the melt-cast binder and the autoignition temperature of the melt-cast composition. TNT has a melting point of about 80.9° C., and COMP B has an autoignition temperature of 167° C., giving a reasonably wide safety margin between the binder melting temperature and the autoignition temperature. On the other hand, many mononitro-substituted and dinitro-substituted arenes have melting points exceeding that of TNT, thereby narrowing the safety margin for melt casting. For example, dinitroanisole has a melting point of 94° C.

The inventors have also discovered a way of overcoming this drawback by combining with the melt cast binder a processing aid selected from the group consisting of alkylnitroanilines and arylnitroanilines. The processing aid combines with the melt-cast binder to lower the overall melting temperature of the melt-cast composition, preferably into a range of from 80° C. to 90° C., while raising the autoignition temperature, preferably to about 149° C. (300° F.), of the composition to widen the safety margin.

Additionally, in accordance with the present melt-cast composition the high impact and shock sensitivity commonly associated with melt-cast explosives such as COMP B is mitigated by providing at least a portion of the energetic filler (e.g., RDX) in a fine powder form. It has been discovered by the inventors that the provision of the energetic filler in fine powder form lowers the shock and impact sensitivities of the melt-cast composition. Fine powders have high surface area relative to coarse material. Fine powders stay suspended in the melt phase significantly better than coarse material and will not settle out of the binder as rapidly. This mitigates the formation of a surface rich melt phase and the formation of voids and cracks.

This invention is also directed to ordinances and munitions in which the melt-cast composition of this invention can be used, including, by way of example, mortars, grenades, artillery shells, warheads, and antipersonnel mines.

These and other objects, aspects and advantages of the invention will be apparent to those skilled in the art upon reading the specification and appended claims which, explain the principles of this invention.

DETAILED DESCRIPTION OF THE INVENTION

The melt-cast explosive of this invention includes at least the following: at least one mononitro-substituted and/or dinitro-substituted arene melt-cast binder; at least one N-alkylnitroaniline and/or N-arylnitroanilines processing aid; coarse oxidizer particles, and an energetic filler (e.g, RDX and/or HMX) present at least in part as a fine powder.

Generally, the melt-cast composition comprises from 25 wt % to 45 wt %, more preferably from 30 wt % to 40 wt %, and more preferably about 33.75 wt % of at least one melt-cast binder. Exemplary melt-cast binders suitable for this invention include mononitro-substituted and dinitro-substituted phenyl alkyl ethers having the following formula:

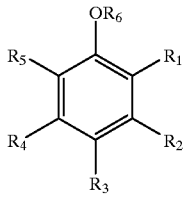

wherein one or two members selected from $R_1$, $R_2$, $R_3$, $R_4$, and $R_5$ are nitro (—$NO_2$) groups, the remaining of $R_1$ to $R_5$ are the same or different and are preferably selected from —H, —OH, —$NH_2$, $NR_7R_8$, an aryl group, or an -alkyl group (such as methyl), $R_6$ is an alkyl group (preferably a methyl, ethyl, or propyl group), $R_7$ is hydrogen or an alkyl or aryl group, and $R_8$ is hydrogen or an alkyl group.

2,4-dinitroanisole (2,4-dinitrophenyl-methyl-ether) and 2,4-dinitrophenotole (2,4-dinitrophenyl-ethyl-ether) are examples of dinitro-substituted phenyl alkyl ethers suitable for use in the present melt-cast composition, while 4-methoxy-2-nitrophenol is an example of an exemplary mononitro-substituted phenyl alkyl ether.

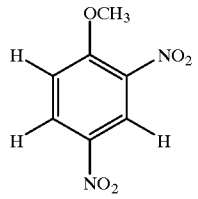

2,4-dinitroanisole (DNAN)

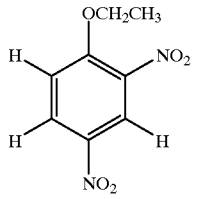

2,4-dinitrophenotole

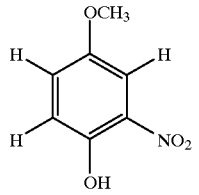

4-methoxy-2-nitrophenol

DNAN, along with fine, high surface area material, has been found (and 2,4-dinitrophenotole and 4-methoxy-2-nitrophenol are also believed) to exhibit less tendency to shrink and crack than TNT. The reduced shrinkage and cracking of DNAN is believed to be attributable to the fact that DNAN does not crystallize as easily as TNT during solidification that following melt casting.

As referred to herein, arenes encompasses arene derivatives such as phenols and aryl amines. For example, mononitro-substituted and dinitro-substituted arene melt-cast binders suitable for use with this invention include nitrophenols, such as meta-nitrophenol, para-nitrophenol, and 2-amino-4-nitrophenol; dinitrophenols, such as 2,4-dinitrophenol and 4,6-dinitro-o-cresol; nitrotoluene and dinitrotoluenes, such as 2,4-dinitrotoluene; mononitroanilines, such as ortho-nitroaniline, meta-nitroaniline, para-nitroaniline; and dinitroanilines, such as 2,4-dinitroaniline and 2,6-dinitroaniline. As referred to herein, arenes also include polycyclic benzenoid aromatics such as mononitronaphthalenes and dinitronaphthalenes (e.g., 1,5-dinitronapthalene).

The mononitro-substituted and dinitro-substituted arenes generally have a much lower toxicity than TNT, particularly when the arenes do not contain —OH and/or —$NH_2$ functionalities. Thus, in many instances the use of mononitro-substituted and dinitro-substituted arenes often simplifies handling and reduces the costs associated with manufacturing the melt-cast explosive.

The processing aid of this invention preferably is one or more N-alkyl-nitroanilines and/or N-aryl-nitroanilines having the following formula:

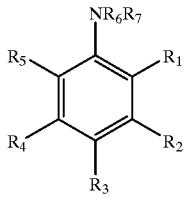

wherein $R_6$ is hydrogen, $R_7$ is an unsubstituted or substituted hydrocarbons (e.g., straight-chain alkyl, branched alkyl, cyclic alkyl, or aryl group), and at least one of $R_1$ to $R_5$ is a nitro group, the remaining of $R_1$ to $R_5$ are the same or different and are preferably selected from —H, —OH, —$NH_2$, $NR_8R_9$, an aryl group, or an -alkyl group (such as methyl), $R_8$ is hydrogen or an alkyl or aryl group, and $R_9$ is hydrogen or an alkyl group. Exemplary N-alkyl-nitroaniline processing aids include the following:

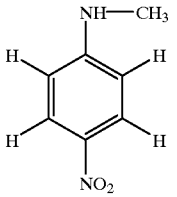

N-methyl-p-nitroaniline (MNA)

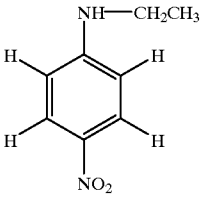

N-ethyl-p-nitroaniline

Examples of aryl-nitroaniline processing aids include the following:

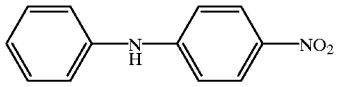

4-nitrodiphenylamine

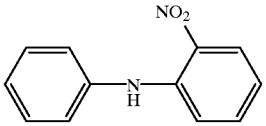

2-nitrodiphenylamine

The concentration of the processing aid is selected in order to widen the "safety margin" at which the melt-cast composition can be melt poured without significant threat of auto-ignition of the composition. The processing aid generally acts to lower the melting point of the mixture of melt-cast binder and processing aid towards (but not necessarily to) its eutectic point. By controlling the amount of the processing aid, the melting point of the mixture of melt-cast binder and processing aid can be adjusted into a range of 80° C. to 110° C. that generally characterizes melt-cast materials. More preferably, the melting point is adjusted to 80° C. to 90° C., and more preferably about 86° C. Simultaneously, the processing aid has been found to raise the auto-ignition (or exotherm) temperature of the melt-cast composition, thereby widening the safety margin between the melting temperature and the auto-ignition temperature of the melt-cast composition. While not wishing to be bound by any theory, it is postulated that there is a possibility that the processing aid may also impart a secondary benefit of functioning as a NO scavenger.

The concentration of the processing aid can be selected by taking into account the amount of melt-cast binder in the overall melt-cast composition, the purity of the melt-cast binder, and the nitrogen content of the melt-cast binder. Generally, the melt-cast composition can include from about 0.15 wt % to about 1 wt % processing aid based on the total weight of the melt-cast composition. More than 1 wt % lower the temperature of the melt-cast binder/processing aid mixture below about 80° C.

Representative inorganic materials that can be used as the coarse oxidizer particles in the present melt-cast explosive composition include perchlorates, such as potassium perchlorate, sodium perchlorate, and ammonium perchlorate; and nitrates, such as potassium nitrate, sodium nitrate, ammonium nitrate, copper nitrate ($Cu_2(OH)_3NO_3$, and hydroxylammonium nitrate (HAN); ammonium dinitramide (AND); and hydrazinium nitroformate (HNF). Organic oxidizers having excess amounts of oxygen available for oxidizing the melt-cast binder can also be used. An example of a suitable organic oxidizer is CL-20. The coarse particles preferably having particle diameters, on average, on the order of from about 20 $\mu$m to about 600 $\mu$m, more preferably 200 $\mu$m to 400 $\mu$m, and still more preferably about 400 $\mu$m. Particles having an average diameter of less than about 20 $\mu$m are DoD/DoT explosive class 1.1, and therefore highly detonable and sensitive. The coarse oxidizer particles preferably constitute from 10 wt % to 55 wt %, more preferably from 20 wt % to 45 wt %, and still more preferably about 35 wt % of the overall melt-cast composition.

Similar to COMP B, which contains RDX as an energetic filler, the melt-cast explosive composition of this invention also contains at least one energetic filler. In the present melt-cast explosive composition, the energetic filler can be RDX, a nitramine other than RDX, or a combination of RDX and other nitramines. Representative nitramines that may be used in accordance with this invention include 1,3,5,7-tetranitro-1,3,5,7-tetraaza-cycloocatane (HMX), 2,4,6,8,10,12-hexanitro-2,4,6,8,10,12-hexaazatetracyclo-[$5.5.0.0^{5,9}0^{3,11}$]-dodecane (HNIW), and 4,10-dinitro-2,6,8,12-tetraoxa-4,10-diazatetracyclo-[$5.5.0.0^{5,9}0^{3,11}$]-dodecane (TEX). In addition or as an alternative to the use of these nitramines, other energetic materials can be used in the present melt-cast composition, including, by way of example, nitroguanidine (NQ), 1,3,5-triamino-2,4,6-trinitrobenzene (TATB), 1,1-diamino-2,2-dinitro ethane (DADNE), 1,3,3-trinitroazetidine (TNAZ), and 3-nitro-1,2,4-triazol-5-one (NTO).

The overall weight percentage of the melt-cast explosive composition attributed to the energetic filler is preferably not more than 60 wt %, more preferably in a range of from 20 wt % to 60 wt %, more preferably in a range of from 30 wt % to 40 wt %.

It has been discovered by the inventors that the shock and impact sensitivity of the melt-cast explosive can be reduced by including a substantial portion of the energetic filler in a fine powder form, preferably having particle sizes in a range of from about 2 $\mu$m to about 10 $\mu$m, more preferably about 2 $\mu$m. However, an excess amount of fine powder energetic filler in the melt-cast composition can adversely affect the pourability of the composition. Generally, about 18 wt % to about 54 wt % of the composition should be fine powder energetic filler. The remainder of the energetic filler in the melt-cast composition can have larger particle sizes, such as on the order of about 100 $\mu$m, to ensure that the composition remains melt-pourable.

According to one preferred embodiment, the composition comprises 34 wt % dinitroanisole (DNAN), 0.25 wt % N-methyl-p-nitroaniline (MNA), 30 wt % of 400 μm ammonium perchlorate (AP), 5 wt % of 100 μm RDX, and 30.75 wt % of 2 μm RDX.

Additional ingredients can also be introduced into the melt-cast composition of this invention. For example, a particularly desirable additional ingredient comprises reactive metals, such as aluminum, magnesium, boron, titanium, zirconium, silicon, and mixtures thereof. Reactive metals are particularly useful in applications in which the melt-cast explosive is submerged or otherwise exposed to large amounts of water.

Preferably, the melt-cast composition of this invention is substantially free of polymeric binders conventionally found in pressable and extrudable energetic materials, since an undue amount of these polymeric binders can lower the energy (especially for non-energetic polymer binders) and reduce the melt pourability (by increasing the viscosity) of the melt-cast explosive.

EXAMPLES

The following examples illustrate embodiments which have been made in accordance with the present invention. Also set forth are comparative examples prepared for comparison purposes. The inventive embodiments are not exhaustive or exclusive, but merely representative of the invention.

Unless otherwise indicated, all parts are by weight.

Examples 1 and 2 were prepared as follows. The dinitroanisole (DNAN) was introduced into a melt kettle and heated to melt the DNAN into a liquid state. The processing aid N-methyl-p-nitroaniline (MNA) was also added at this time. While stirring, the fine RDX was added at a sufficiently slow rate to facilitate thorough wetting of the RDX fine powder. The coarse RDX was then added by stirring, followed by the ammonium perchlorate inorganic oxidizer, which was also added while stirring. Once homogeneous, stirring was increased for another hour, then poured into an ordnance and allowed to cool at ambient conditions.

Comparative Example A and COMP B were prepared under similar conditions, but without the processing aid.

TABLE I

| | Example 1 | Example 2 | Comparative Example A | COMP B |
|---|---|---|---|---|
| DNAN | 33.75 | 27.5 | 28 | |
| MNA | 0.5 | 0.5 | | |
| Ammonium perchlorate (AP) | 25 | 12 | 12 | |
| RDX (1.8 μm) | 30.75 | 30 | 30 | |
| RDX (100 μm) | 10 | 30 | 30 | 59.5 |
| TNT | | | | 39.5 |
| Paraffin | | | | 1.0 |
| Cards | 155 | 188 | 188 | 203 |
| Energy of Detonation | 9.2 | 9.5 | 9.5 | 9.5 |
| MP (° C.) | 86 | 91 | 93 | 81 |
| Exotherm (° C.) | 167 | 167 | 139 | 167 |
| Safety Margin | 81 | 76 | 46 | 86 |

The card gap test measures shock sensitivity by loading a sample into a card gap pipe and setting off an explosive primer a predetermined distance from the sample. The space between the primer and the explosive charge is filled with an inert material such as PMMA (polymethylmethacrylate). The distance is expressed in cards, where 1 card is equal to 0.01 inch (0.0254 cm), such that 100 cards equals 1 inch (2.54 cm). If the sample does not explode at 100 cards, for example, then the explosive is nondetonable at 100 cards. Thus, the lower the card value, the lower the shock sensitivity.

Example 1 exhibited a card gap value of 155, which is almost 20% lower than Comparative Example A (188 cards) and more than 20% lower than COMP B (203 cards).

Additionally, a comparison of Example 2 and Comparative Example A shows that the presence of MNA in the inventive composition lowered the melting temperature and raised the exotherm temperature, while not adversely affecting card gap. Hence, the "safety margin" at which Example 2 can be melt cast is increased by 30° C. over that of Comparative Example A.

The foregoing detailed description of the preferred embodiments of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

What is claimed is:

1. A melt-cast explosive composition comprising:

at least one binder comprising at least one member selected from the group consisting of mononitro-substituted and dinitro-substituted phenyl alkyl ethers;

at least one processing aid comprising at least one member selected from the group consisting of N-alkylnitroanilines and N-arylnitroanilines, the at least one processing aid and the at least one binder forming a mixture having a melting temperature in a range of from about 80° C. to about 110° C.;

oxidizer particles havingparticle diameters in a range of from about 20 μm to about 600 μm; and at least one energetic filler havingparticle sizes in a range of from about 20 μm to about 10 μm;

wherein the melt-cast explosive composition is melt-pourable at at least one temperature in the range of from about 80° C. to about 110° C.

2. The melt-cast explosive composition of claim 1, wherein the at least one processing aid is present from about 0.15 weight percent to about 1 weight percent of a total weight of the melt-cast explosive composition.

3. The melt-cast explosive composition of claim 1, wherein the at least one binder is present from 25 weight percent to 45 weight percent of the total weight of the melt-cast explosive composition.

4. The melt-cast explosive composition of claim 1, wherein the at least one binder is present from 25 weight percent to 45 weight percent of the total weight of the melt-cast explosive composition.

5. The melt-cast explosive composition of claim 1, wherein the at least one binder is free of $-NH_2$ functionalities.

6. The melt-cast explosive composition of claim 1, wherein the at least one binder comprises at least one member selected from the group consisting of 2,4-dinitroanisole, 2,4-dinitrophenotole, and 4-methoxy-2-nitrophenol.

7. The melt-cast explosive composition of claim 1, wherein the at least one binder comprises 2,4-dinitroanisole.

8. The melt-cast explosive composition of claim 1, wherein the at least one energetic filler comprises at least one member selected from the group consisting of 1,3,5-trinitro-1,3,5-triaza-cyclohexane (RDX), 1,3,5,7-tetranitro-1,3,5,7-tetraaza-cycloocatane (HMX), 2,4,6,8,10,12-hexanitro-2,4,6,8,10,12-hexaazatetracyclo[$5.5.0.0^{5,9}0^{3,11}$] dodecane (HNIW), 4,10-dinitro-2,6,8,12-tetraoxa-4,10-diazatetracyclo-[$5.5.0.0^{5,9}0^{3,11}$]-dodecane (TEX), nitroguanidine (NQ), 1,3,5-triamino-2,4,6-trinitrobenzene (TATB), 1,1-diamino-2,2-dinitro ethane (DADNE), 1,3,3-trinitroazetidine (TNAZ), and 3-nitro-1,2,4-triazol-5-one (NTO).

9. The melt-cast explosive composition of claim 1, wherein the oxidizer particles comprise at least one member selected from the group consisting of inorganic perchlorates and inorganic nitrates.

10. The melt-cast explosive composition of claim 1, wherein the at least one energetic filler comprises 1,3,5-trinitro-1,3,5-triaza-cyclohexane (RDX).

11. A melt-cast explosive composition comprising:

at least one melt-cast binder comprising at least one member selected from the group consisting of mononitro-substituted and dinitro-substituted phenyl alkyl ethers;

at least one processing aid comprising at least one N-alkylnitroanilines, said processing aid and said melt cast binder forming a mixture having a melting temperature in a range of from about 80° C. to about 110° C.;

at least one inorganic oxidizer havingparticle diameters from about 20 $\mu$m to about 600 $\mu$m; and at least one energetic filler havingparticle sizes from about 2 $\mu$m to about 10 $\mu$m;

wherein the melt-cast explosive composition is meltpourable at at least one temperature in the range of from about 80° C. to about 110° C.

12. The melt-cast explosive composition of claim 11, wherein the at least one processing aid is present from about 0.15 weight percent to about 1 weight percent of a total weight of the melt-cast explosive composition.

13. The melt-cast explosive composition of claim 11, wherein the at least one binder is present from about 25 weight percent to 45 weight percent of the total weight of the melt-cast explosive composition.

14. The melt-cast explosive composition of claim 11, wherein the at least one binder is present from 30 weight percent to 40 weight percent of the total weight of the melt-cast explosive composition.

15. The melt-cast explosive composition of claim 11, wherein the at least one binder is free of —$NH_2$ functionalities.

16. The melt-cast explosive composition of claim 11, wherein the at least one processing aid comprises N-methylnitroaniline.

17. The melt-cast explosive composition of claim 11, wherein the at least one binder comprises at least one member selected from the group consisting of 2,4-dinitroanisole, 2,4-dinitrophenotole, and 4-methoxy-2-nitrophenol.

18. The melt-cast explosive composition of claim 11, wherein the at least one binder comprises 2,4-dinitroanisole.

19. The melt-cast explosive composition of claims 11, wherein the at least one inorganic oxidizer comprises at least one member selected from the group consisting of inorganic perchlorates and inorganic nitrates.

20. The melt-cast explosive composition of claim 11, wherein the at least one energetic filler comprises 1,3,5-trinitro-1,3,5-triaza-cyclohexane (RDX).

21. The melt-cast explosive composition of claim 11, wherein the at least one inorganic oxidizer comprises ammonium perchlorate.

* * * * *